United States Patent [19]

De Benedittis et al.

[11] Patent Number: 4,895,272

[45] Date of Patent: Jan. 23, 1990

[54] LIQUID STORAGE SYSTEM

[75] Inventors: Louis De Benedittis, Nesconset, N.Y.; Charles Frey, Sr., Lancaster, Pa.

[73] Assignee: Areo Power Unitized Fueler Company, Inc., Smithtown, N.Y.

[21] Appl. No.: 217,549

[22] Filed: Jul. 11, 1988

[51] Int. Cl.[4] ..... B65D 25/18; B65D 25/24

[52] U.S. Cl. ..... 220/85 S; 220/85 VR; 220/5 A; 220/18; 220/1 B

[58] Field of Search ..... 220/5 A, DIG. 24, 85 S, 220/85 VR, 85 VS, 85 V, 18, 1 B, 466, 20.5, 445; 72/49.2 T

[56] References Cited

U.S. PATENT DOCUMENTS

| | | | |
|---|---|---|---|
| 2,041,320 | 5/1936 | Bradley | 220/DIG. 24 |
| 2,297,002 | 9/1942 | Larson | 220/18 |
| 2,405,442 | 8/1946 | Mayo | 220/20.5 |
| 2,670,873 | 3/1954 | Whidden | 220/20.5 |
| 2,703,607 | 3/1955 | Simmonds | 220/20.5 |
| 2,955,723 | 10/1960 | McGrath | 220/20.5 |
| 3,848,765 | 11/1974 | Dürkop | 220/18 |

*Primary Examiner*—Stephen Marcus
*Assistant Examiner*—Gilbert Reece
*Attorney, Agent, or Firm*—Darby & Darby

[57] ABSTRACT

A storage system for liquid is disclosed which includes an external containment vessel which is open on top and an internal storage tank mounted within the external containment vessel so as to extend above it. The internal tank and the containment vessel are constructed and arranged so as to have a substantial outer storage space formed between them. This storage space is covered by a roof structure which extends from a point below the top of the internal storage tank to cover the containment vesel. A venting structure is provided at a location on the internal tank above the roof structure, where it is exposed to the atmosphere, and a drainage structure provides liquid coupling from the venting structure to the outer storage space.

13 Claims, 4 Drawing Sheets

LIQUID STORAGE SYSTEM

FIELD OF THE INVENTION

The present invention relates generally to storage tanks for liquids and, more particularly, concerns an above-ground containment system for safe, pollution-free storage of flammable liquids, such as aviation fuel, and toxic or corrosive non-flammable liquids, such as detergents and dry cleaning chemicals.

BACKGROUND OF THE INVENTION

The storage of volatile, toxic fluids has long presented a safety and environmental hazard. Aviation fuel is among the most volatile of liquids and is stored in large quantities throughout the country. Underground storage tanks have been used in the aviation industry for the storage of fuel and other highly volatile liquids, but such tanks have serious drawbacks, in that their construction and maintenance are expensive, and owing to their lack of mobility. Recently, underground storage tanks have come under attack on environmental grounds, as it is difficult to determine when the tank has been ruptured or damaged so as to permit volatile, and often toxic, materials to escape and pollute the environment.

In the aviation industry flammable liquids, including fuel having a comparatively low vapor pressure, have been stored in above-ground storage tanks which are vented to the atmosphere. In the event such a flammable liquid gets excessively warm while in a storage tank, it produces considerable vapor within the tank, the pressure of which can readily be relieved, in an above-ground tank, to prevent the tank from rupturing.

Relatively small vents are usually provided in a storage tank to take care of normal atmospheric changes. To handle the large quantity of vapor produced by a flammable liquid under excessive heating, it is important that the tank be relieved with a sufficiently large area vent, to prevent rupture.

Above-ground fuel storage tanks for holding volatile or toxic liquids would be desirable, but existing tanks of this type have their own attendant shortcomings.

Vapors of a stored liquid can condense on an outside surface of the tank upon passing through the vents, owing to a temperature differential between the interior and exterior of the tank. Such condensation of relatively low volatility liquids, mechanical rupture in the case of flammable liquid, and corrosion, in the case of all types of liquids, can result in uncontrolled dripping or leaking of the liquid on the outside surface of the storage tank. Uncontrolled leaks can also result from the overflow of a flammable liquid through the vents when a storage tank is overfilled.

The results of such uncontrolled leaks are: penetration of the body of the storage tank, leading to the interruption of use of the storage facility until the necessary repairs can be made; the fire hazard represented by an uncontrolled pool of highly flammable liquid in the near vicinity of the storage tank; the health hazard of having toxic liquids seep into the soil, possibly finding their way into the food chain or water supplies; and the financial loss resulting from the loss of expensive liquid.

Above-ground tanks must provide for avoiding environmental pollution resulting from damage to the tank and escape of the contents. A further problem with above-ground fuel storage tanks is that they are also subject to exposure to the elements, must be constructed to avoid overflow of the contents due to expansion as a result of heating), and must contend with corrosion and contamination from rain, snow and other environmental factors.

It is an object of the present invention to provide an above-ground liquid storage system which is safe, inexpensive to construct and maintain, and relatively mobile.

Another object of the invention is to provide a storage system for liquid in which the development of leaks, including leaks due to an overflow of liquid through the vents and leaks resulting from condensation of vapors passing through the vents of the tank, will not result in the loss of the liquid.

An important object of the present invention is to provide a liquid storage tank which can collect and recover liquid which may leak from the tank.

It is a further object of the present invention to provide an above-ground fuel storage tank that avoids the inspection problems inherent in underground storage tanks but provides means for protecting against escape of the contents due to corrosion, rupture of the tank wall, leakage or expansion of the liquid in the tank, thereby avoiding pollution or contamination of the environment.

A liquid storage system in accordance with the present invention includes an external containment vessel which is open on top and an internal storage tank mounted within the external containment vessel so as to extend above it. The internal tank and the containment vessel are constructed and arranged so as to have a substantial outer storage space formed between them. This storage space is covered by a roof structure which extends from a point below the top of the internal storage tank to cover the containment vessel. A venting structure is provided at a location on the internal tank above the roof structure, where it is exposed to the atmosphere, and a drainage structure provides liquid coupling from the venting structure to the outer storage space.

BRIEF DESCRIPTION OF THE DRAWINGS

Other advantages and features of the invention are described with reference to the embodiments shown in the drawings which are intended to illustrate, and not to limit, the invention, and in which.

DETAILED DESCRIPTION OF THE PREFERRED EMBODIMENTS

Figure 1:
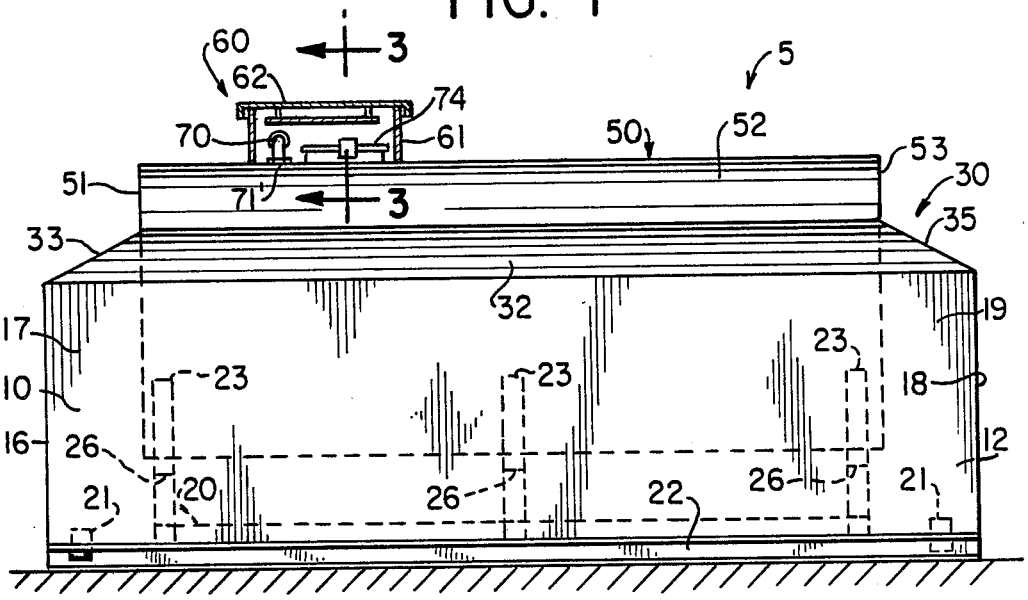
FIG. 1 is a front view, partially in section, illustrating a fuel storage system embodying the present invention.

Although specific embodiments of the invention will now be described with reference to the drawings, it should be understood that the embodiments shown are by way of example only. Various additions, deletions and modifications, obvious to one skilled in the art to which the invention pertains, are possible without departing from the spirit, scope and contemplation of the invention.

Referring to FIGS. 1–5, there is illustrated a storage system 5 for a flammable liquid, indicated generally by the reference numeral 5. Storage system 5 broadly comprises an external containment vessel 10 with an open top and an internal storage tank 50. The internal storage tank 50 protrudes substantially above the external containment vessel 10 and is topped by a venting structure 60, discussed in detail below. The tank 50 is preferably mounted substantially horizontally within the containment vessel 10 so as to extend along its length and so that a substantial void or storage space 55 is formed between the external containment vessel 10 and the outside surface of the internal tank 50. A roof structure 30 covers the external containment vessel, to enclose storage space 55, and a drainage structure 80 connects the venting 60 structure to the storage space 55.

In operation, aviation fuel may be stored in the internal tank 50. The venting structure 60 couples the interior of tank 50 to the external atmosphere and serves to relieve excess internal pressure. Any fuel that overflows into the venting structure 60 or condenses on the exterior of tank 50 is captured in storage space 55. Roof structure 30 protects storage space 55 against contamination by rain or airborne contaminants, so that substantially uncontaminated fuel may be captured in the storage space. Periodically, this fuel may be recovered by draining the storage space.

Those skilled in the art will appreciate that the invention is not limited to liquid storage systems, per se, but also extends to other types of systems which store liquids in tanks. For example, it will be understood that it is a common practice to combine a storage tank with pumping equipment which can pump fuel from the interior of the tank, so as to provide a fuel dispensing system. Accordingly, as used herein the term "fuel storage system" will be understood to have it s broadest meaning, and it is specifically intended to encompass other types of systems which store liquid in a tank, such as the fuel dispensing systems discussed above.

The external containment vessel 10 is preferably a box-shaped enclosure formed by front wall 12, rear wall 14 and side walls 16 and 18 so as to include an open top. These walls are supported by a base portion 20 of the containment vessel. The containment vessel is preferably made of heavy gauge steel and is appropriately coated to avoid corrosion of the tank and its being attacked by the liquid to be stored. The tank may also be constructed of fuel resistant plastic material.

The internal storage tank 50 is also preferably made of heavy gauge, coated steel, but it may also be made of a plastic material which is resistant to attack by the liquid being stored. It has a substantially cylindrical wall 52 and two end walls 51 and 53.

Figure 2:
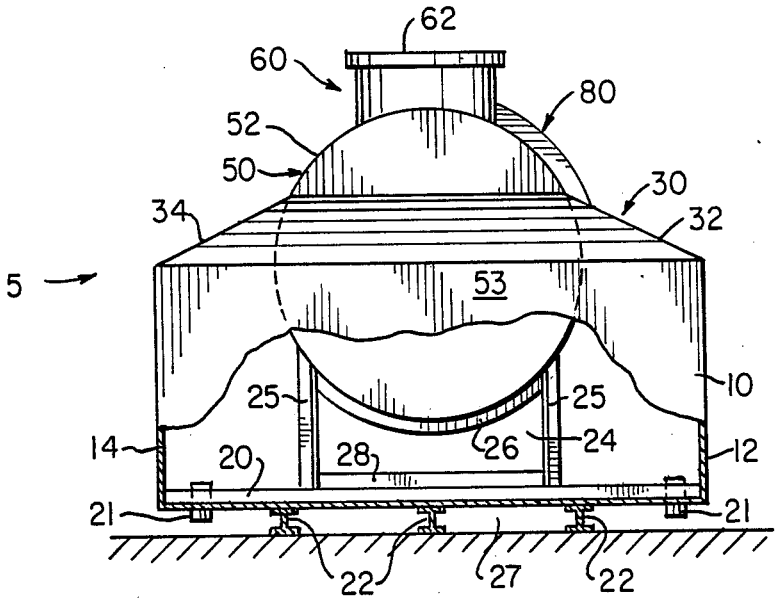
FIG. 2 is a side view of the storage system of FIG. 1, also partially in section.

Roof structure 30 comprises the roof sections 32 and 34, each of which is secured to the cylindrical wall 52 of the storage tank 50 and to the top of containment vessel 10 so as to overhang the containment vessel side walls (see FIG. 2). In the illustrative embodiment of FIG. 1, the roof sections 32 and 34 are somewhat shorter at their tops than the containment vessel 10, and end roof sections 33 and 35 are provided which extend between the end walls 51 and 53 of the storage tank and the tops of walls 16 and 18 of the containment vessel. Those skilled in the art will appreciate that the roof sections 32 and 34 could be the same length as the containment vessel 10, in which case the roof structure 30 has the form of a conventional gable roof. arrangement in which the roof portion has inclined branches. Tank structures having an arcuate, or pyramid-shaped roof structure or any other geometric roof configuration are within the scope of the present invention.

Figure 3:
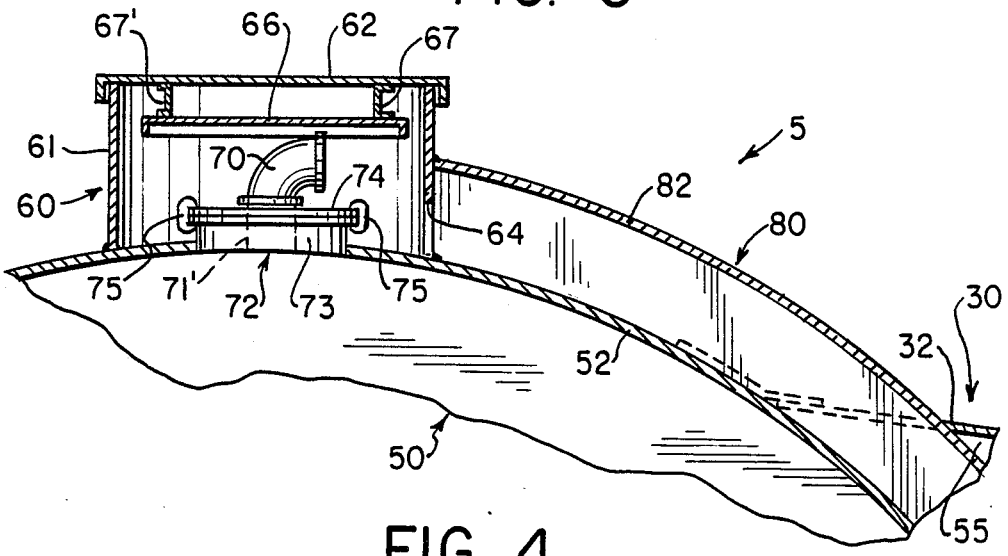
FIG. 3 is an fragmentary, enlarged sectional view of an upper part of the fuel storage system taken along line III—III in FIG. 1.
Figure 4:
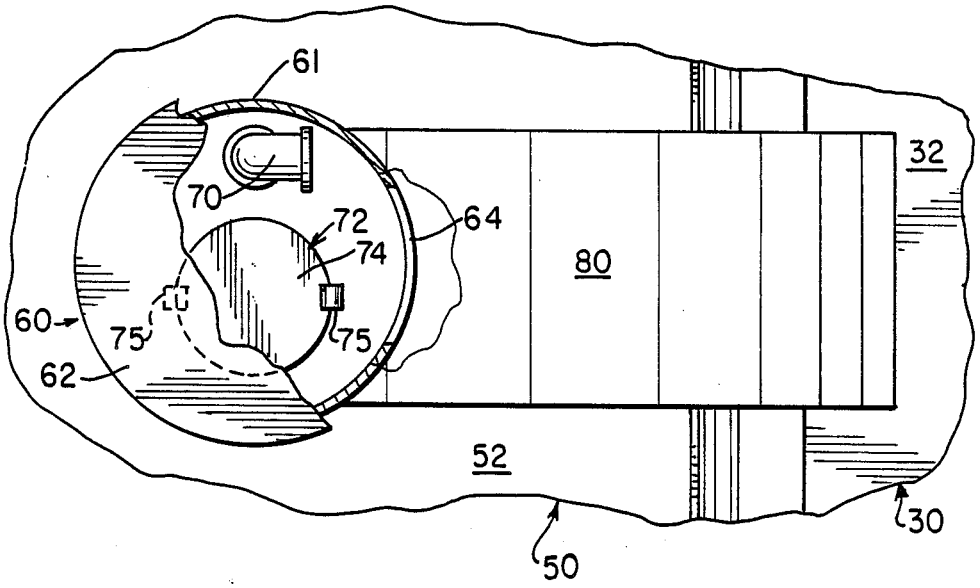
FIG. 4 is a fragmentary, enlarged top view of the storage system of FIG. 1, with portions cut away to show internal details of the venting structure.

FIGS. 3 and 4 show a housing 65 for the drainage structure 60, the housing having a cylindrical wall 61 and a closable cover 62. The housing is positioned on a top portion of the cylindrical tank 50. A small area vent 70 and a large area vent 72 are situated within the housing 60. The small area vent 70 connects the interior of the tank 50 with an exterior portion of the housing 60 through a neck 71, The large area vent 72 generally comprises a cylindrical wall 73 and a closure 74. The wall 73 passes through the cylindrical wall 52 of the storage tank. A breakable attaching device 75 is preferably provided for attaching the cover 62 to the wall 73. Under normal conditions the cover 62 seals the wall 73. The attaching device is adapted to break in the event of excessive pressure build up within the internal tank 50, thereby providing an emergency vent for pressure relief. The breakable attaching device may include a plurality of separate, breakable sections, each constructed to break at a different predetermined pressure level within the storage tank.

As best seen in FIG. 3, a baffle plate 66 is attached to an inside surface of the cover 62 through connecting elements 67 and 67'. When the cover 62 is closed, the baffle plate 66 is disposed substantially horizontally and lies in spaced relationship to and immediately above the vents 70 and 72. The baffle plate 66 is designed to deflect the vapors of the flammable liquid and the flammable liquid itself passing through the vents 70 and 72 at an area of engagement between the wall 61 and the cover 62 of the housing. This construction significantly reduces penetration of vapors and liquid through the seal between the wall 61 and the cover 62. Owing to this feature, when the cover 62 is closed, the escape of flammable liquid through the top of the housing, is substantially limited.

At the connection between the wall 61 of the housing 65 and the cylindrical wall 52 of the internal storage tank, an opening or openings 64 are provided. The opening 64 of the housing 65 is connected by a drain channel structure 80 with the external containment vessel 10. Thus, drain channel structure serves as a passageway to provide liquid communication for the flammable liquid accumulated in the housing 60 into the outer storage space in the containment vessel 10.

The drainage structure 80 comprises a passageway extending from the housing 60, through the roof structure 30, and into the storage space 55 in the external containment vessel 10. As can be seen in FIG. 1, there are at least two drain openings 21 located within the base portion 20 for removal of liquid from the containment vessel 10. These openings are usually located at diagonal corners of the containment vessel.

The base portion 20 of the containment vessel is supported by a plurality of supports 22 so that a gap 27 is defined between the ground and the base portion 20. In FIG. 2, the supports 22 are embodied as I-beams extending axially along the eternal containment vessel.

The internal storage tank 50 is mounted on the base portion 20 of the containment vessel within a saddle arrangement 24. This arrangement has a plurality of saddle members 23 disposed along the longitudinal axis of the cylindrical tank. Each saddle member 23 includes at least two substantially vertical supporting parts 25 and a receiving element 26 which is adapted to closely receive a lower portion of the cylindrical tank. A lower part 28 supported by the base portion 20 of the containment vessel can also be provided by interconnecting two vertical supporting parts 25. The cylindrical tank 50 is typically positioned within the saddle members 23 in such a way that a substantial gap separates the tank from the base portion 20 (see FIG. 2).

Figure 5:
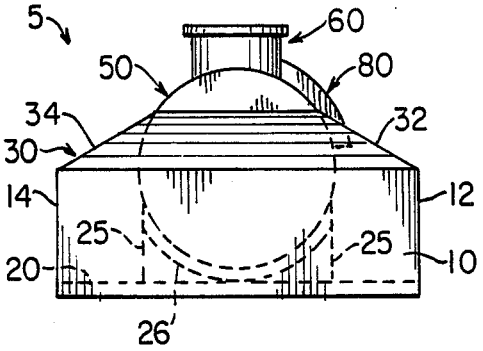
FIG. 5 is a further partially sectional view of the fuel storage arrangement.

FIG. 5 shows an embodiment of the invention where the lower part of the tank 50 contacts the base portion 20.

Figure 6:
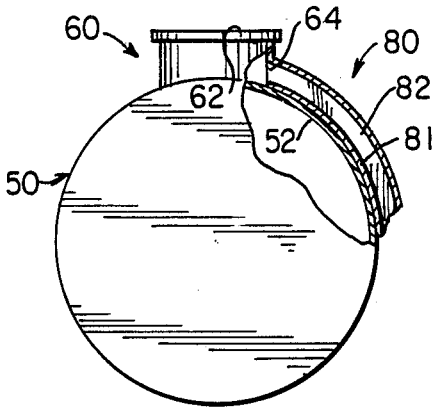
FIG. 6 is a schematic sectional view, similar to FIG. 2, showing a preferred construction for the drainage structure.

As illustrated in FIG. 6 the drainage structure 80 comprises a passageway including the two spaced walls 81 and 82. Naturally, the passageway could be cylindrical, in which case walls 81 and 82 would be part of a single cylindrical tube, or the like. The wall 81 follows the contour of the outside cylindrical wall 52 of the storage tank 50. The cross-section of the drain channel may, however be any closed shape.

Figure 7:
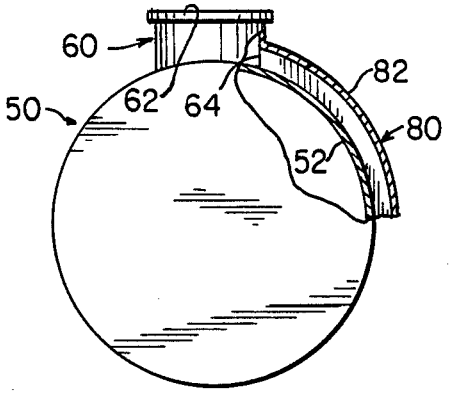
FIG. 7 shows another embodiment of the drainage structure.

FIG. 7 depicts an embodiment of the invention in which the outside wall 52 of the storage tank serves as one wall of the drain channel. In that case, a special anti-corrosion coating of an appropriate type may be provided on at least the portion of the wall 52 serving as a part of the drain channel.

Figure 8:
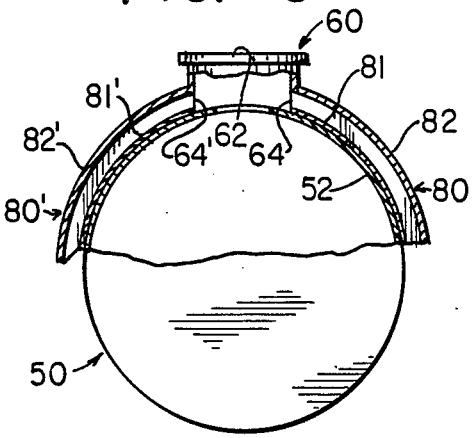
FIG. 8 shows a further embodiment of the drainage structure.

FIG. 8 illustrates an embodiment of the invention where the drain channel has two branches 80 and 80, which extend along either side of the housing 60. In that case two diametrically opposed openings 64 and 64, should be provided in the housing.

During operation of the storage arrangement of the present invention, flammable liquid vapors from within the internal storage tank 50 and the flammable liquid itself (e.g. overflowing liquid) pass through the vents 70 and 72 are condensed (in the case of the vapors), and collected inside the lower part of the housing 60. The collected liquid is transferred through the opening 64, through the drain channel 80, which passes through the roof 30, into the containment vessel 10. After a predetermined quantity of the flammable liquid has been accumulated, it can be removed from the containment vessel 10 through the openings 21 situated in the base portion 20. The roof 30 protects the collected flammable liquid while it is in the containment vessel 10.

Figure 9:
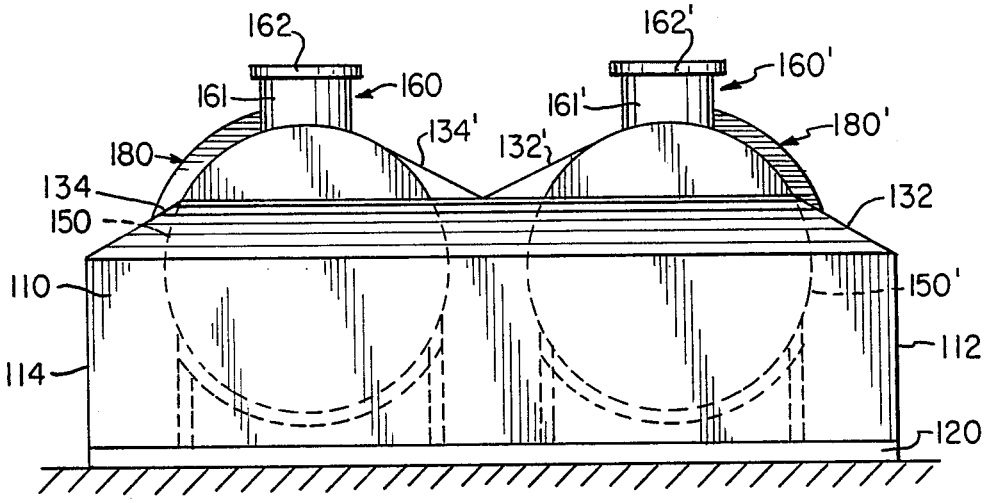
FIG. 9 is a schematic, partially sectional view showing the fuel storage system having two internal tanks.

FIG. 9 illustrates a liquid storage system having two cylindrical internal storage tanks 150 and 150, positioned to extend along and within the external containment vessel 110. Preferably, the longitudinal axes of the tanks 150 and 150, are substantially parallel to each other and to the base portion of the containment vessel. Housings 160 and 161, having walls 161 and 161', and covers 162 and 162' are positioned on top of the tanks 150 and 150', respectively. At least one vent similar to the vents 70 and 72 is situated in each housing.

The roof structure 130 of this embodiment includes roofs 132 and 134 which connect the cylindrical walls of the storage tanks 150 and 150', with the walls 112 and 114 of the containment vessel 110. Two additional roofs 132' and 134', which intersect to form a V-shape, cover the space between the storage tanks 150 and 150'. The roofs 132' and 134' can be manufactured as individual units or as an integral assembly. End roof sections (not shown) are designed to cover the spaces between the storage tanks 150 and 150' and the other walls of the containment vessel 110.

The drain channels 182 and 182' which pass through the roof connect the housings 160 and 160' with the containment vessel.

Storage systems with three or more horizontal tanks positioned in the same containment vessel and/or having a roof structure in an arc shape or any other configuration are within the scope of this invention.

Figure 10:
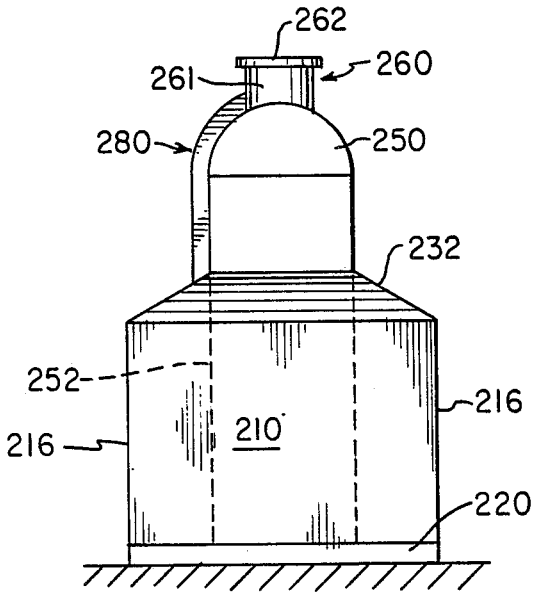
FIG. 10 is a schematic, partially sectional view of a fuel storage system with a substantially vertical internal storage tank.

FIG. 10 illustrates a storage system having a substantially vertical internal storage tank 250 positioned inside an external containment vessel 210. The storage tank is provided with a cylindrical wall 252 and hemispherical upper portion 254. A housing 260 containing a cylindrical wall 261 and a cover 262 is positioned on the upper portion 254 of the storage tank. At least one vent (not shown) is positioned within the housing. This vent connects the interior of the storage tank with the interior of the housing. At least one opening (not shown) is provided at the connection between the wall 261 of the housing and the hemispherical upper portion 254. The interior of the housing communicates through the openings and a drain channel 280 with the external containment vessel 210.

The containment vessel 210 is defined by four side walls 216 and a base portion 220. At least one opening is provided within the base portion 220 for removal of liquids accumulated in the containment vessel. A roof structure 230 includes four roof branches 232 extending between the cylindrical wall 252 of the storage tank and the upper portion of the walls 216 of the containment vessel. The drain channel 280 passes through the roof structure 230.

Storage systems which include two or more substantially vertical internal storage tanks positioned in the same containment vessel are within the general concept of the invention. Furthermore, an arc shaped or any other configuration of roof structure are within the scope of this invention.

Although preferred forms of the invention have been disclosed for illustrative purposes, those skilled in the art will appreciate that many additions, modifications and substitutions are possible, without departing from the scope and spirit of the invention as defined in the accompanying claims.

What is claimed is:

1. An above-ground storage system for holding volatile, corrosive and toxic liquids, comprising:

a closed external containment vessel having a top which is open to the exterior of said storage system;

at least one closed internal storage tank mounted within the external containment vessel so as to protrude substantially thereabove and so as to form an outer storage space between said containment vessel and said internal storage tank;

venting means mounted near the top of said internal storage tank for venting said interior storage tank to the atmosphere;

a roof structure extending from a point on said internal storage tank below said venting means and over said containment vessel so as to cover said outer storage space, while permitting venting of said outer storage space to the atmosphere; and drainage means for providing liquid communication from said venting means to said outer storage space;

whereby vapors and liquid contained from said external storage tank which passing through said venting means are collected within said outer storage space through said drainage means.

2. A fuel storage system according to claim 1 wherein said internal storage tank comprises a substantially cylindrical wall and two end walls, a longitudinal axis of the cylindrical wall being positioned substantially horizontally along an axis of the external containment vessel, said venting means including a housing having at least one opening in a lower portion of the housing, said drainage means extending from said opening, along the cylindrical wall of the internal storage tank, and into the external containment vessel.

3. A system according to claim 2 wherein said drainage means includes two walls extending along the cylindrical wall of the tank.

4. A system according to claim 3 wherein one wall of the drainage means it the cylindrical wall of the internal storage tank.

5. A system according to claim 2 wherein said drainage means comprises a tube.

6. A system according to claim 2 wherein at least two openings are provided in the lower part of said housing, said openings being diametrically opposed, said drainage means having a plurality of branches each connecting a respective opening of said housing to said outer storage space.

7. A system according to claim 2 wherein said external containment vessel comprises a base portion supporting at least one side wall defining a closed contour, said substantially cylindrical internal storage tank being fixedly attached to the base portion.

8. A system according to claim 1 wherein said venting means comprises at least two vents of different cross-sectional area are positioned within a housing, said housing having a cover with a baffle plate attached to a surface thereof facing the interior of the housing.

9. A system according to claim 2 wherein said containment vessel has two side walls and two end walls, said roof structure further comprising at least two side roof branches extending laterally at either side of the cylindrical wall of the storage tank onto an upper surface of said two side walls of the containment vessel, the entire open top of the containment vessel being covered by the roof structure.

10. A system according to claim 2 wherein a plurality of said substantially cylindrical storage tanks are provided within the external containment vessel, the longitudinal axes of said cylindrical tanks being parallel to each other and extending substantially horizontally along the containment vessel, one of said housings being provided within the upper portion of each said internal storage tanks, at least one of said venting means is provided in each said housing, the interior of each said housing being connected with the containment vessel by said drainage means.

11. An above-ground storage system for holding volatile, corrosive and toxic liquids, comprising:

a closed external containment vessel having an open top;

at least one closed internal storage tank mounted within the external containment vessel so as to protrude substantially thereabove and so as to form an outer storage space between said containment vessel and said internal storage tank, said internal storage tank comprising a substantially cylindrical wall and two end walls, a longitudinal axis of the cylindrical wall being positioned substantially horizontally along an axis of the external containment vessel;

venting means mounted near the top of said internal storage tank for venting said interior storage tank to the atmosphere, said venting means including a housing having at least one opening in a lower portion of the housing;

a roof structure extending from a point on said internal storage tank below said venting means and over said containment vessel so as to cover said outer storage space; and drainage means for providing liquid communication from said venting means to said outer storage space, said drainage means extending from said opening, along the cylindrical wall of the internal storage tank, and into the external containment vessel, whereby vapors and liquid contained from said internal storage tank which passing through said venting means are collected within said outer storage space through said drainage means;

a plurality of said substantially cylindrical storage tanks being provided within the external containment vessel, the longitudinal axes of said cylindrical tanks being parallel to each other and extending substantially horizontally along the containment vessel, one of said housings being provided within the upper portion of each of said internal storage tanks, at least one of said venting means being provided in each said housing, the interior of each said housing being connected with the containment vessel by said drainage means;

said containment vessel having two side walls and two end walls, said roof structure further comprising at least two laterally outward roof branches, and two laterally inward roof branches, each outer branch extending from the cylindrical wall of a respective internal storage tank to an upper portion of an adjacent side wall of the containment vessel, each inward branch extending from the cylindrical wall of a respective internal storage tank and being joined with the other inward branch to form a generally V-shaped section.

12. A system according to claim 11 wherein each said drainage means includes at least one channel passing through said roof structure.

13. A system according to claim 1 wherein said internal storage tank further comprises a substantially cylindrical wall having a rounded end portion at one end thereof, said internal storage tank being positioned substantially vertically within the external containment vessel, said venting means being situated on a top part of said rounded end portion of the storage tank.

* * * * *